US007824218B2

(12) United States Patent
Gleissner et al.

(10) Patent No.: US 7,824,218 B2
(45) Date of Patent: Nov. 2, 2010

(54) CONTACT HOLDER ASSEMBLY

(75) Inventors: Brian Gleissner, Woodbury, CT (US); Hardik Parikh, Danbury, CT (US); Gino S. Antonini, New Fairfield, CT (US)

(73) Assignee: Amphenol Corporation, Wallingford, CT (US)

( * ) Notice: Subject to any disclaimer, the term of this patent is extended or adjusted under 35 U.S.C. 154(b) by 100 days.

(21) Appl. No.: 12/242,097

(22) Filed: Sep. 30, 2008

(65) Prior Publication Data

US 2010/0081344 A1 Apr. 1, 2010

(51) Int. Cl.
*H01R 13/40* (2006.01)

(52) U.S. Cl. ..... 439/595; 439/733.1; 439/752

(58) Field of Classification Search ..... 439/595, 439/733.1, 750, 752
See application file for complete search history.

(56) References Cited

U.S. PATENT DOCUMENTS 6,336,832 B2 1/2002 Nobe et al.
6,609,931 B2 8/2003 Parrish et al.
7,029,286 B2 4/2006 Hall et al.
7,316,575 B2 1/2008 Muschketat et al.
7,347,745 B1 * 3/2008 Raudenbush et al. ..... 439/752
7,563,134 B2 * 7/2009 Kim, II ..... 439/578
2003/0092318 A1 * 5/2003 Conway et al. ..... 439/595
2003/0207616 A1 * 11/2003 Nishide ..... 439/595
2005/0054237 A1 3/2005 Gladd et al.
2008/0171466 A1 7/2008 Buck et al.
2009/0130902 A1 * 5/2009 Hall et al. ..... 439/595

* cited by examiner

*Primary Examiner*—Hien Vu
(74) *Attorney, Agent, or Firm*—Blank Rome LLP

(57) ABSTRACT

A contact holder assembly receives a contact. The contact holder assembly includes a movable body portion, a fixed body portion, and a ring elastically combining the movable body portion and the fixed body portion such that the movable body portion moves away from the fixed body portion as the contact holder assembly receives a contact. The movable body portion includes an inner surface and an inclined portion on the inner surface.

19 Claims, 17 Drawing Sheets

CONTACT HOLDER ASSEMBLY

FIELD OF THE INVENTION

The present invention relates to electrical connectors. In particular, the present invention relates to contact holder assemblies that are received in a housing to form an electrical connector.

BACKGROUND OF THE INVENTION

Electrical connectors are generally standardized according to one of many standards. One such standard commonly used in automotive applications is referred to as FAKRA. FAKRA is a standardization group whose name translates into "Automotive Standards Committee in the German Institute for Standardization." FAKRA standards establish how a jack housing must be configured to provide proper keying for mating with an appropriate receptacle and simultaneously allow for connection of a desired coaxial connector into the jack housing. Many electrical connectors have a form that conforms to FAKRA standards.

In automotive applications, a shielded analog signal and power for remote circuitry are often connected close to each other. However, known electrical connectors do not provide a shielded analog signal and power for remote circuitry in the same connector with a form that complies with FAKRA standards. Furthermore, a user must ensure that the contacts for these electrical connectors are properly positioned to prevent possible circuit failure or component damage.

Thus, there is a need for a connector that permits the use of different types of contacts, that holds commonly used contacts, that provides high contact retention, and that provides indication that the contact has been properly positioned.

SUMMARY OF THE INVENTION

Accordingly, the invention provides a contact holder assembly. An aspect of the invention is to be mateable with different contacts. Another aspect is to retain a contact while requiring minimal effort to insert the contact. Yet another aspect is to provide an indication that the contact has been properly positioned.

One embodiment of the invention provides a contact holder assembly. The contact holder assembly includes a movable body portion, a fixed body portion, and a ring elastically combining the movable body portion and the fixed body portion such that the movable body portion moves away from the fixed body portion as the contact holder assembly receives a contact. The movable body portion includes an inner surface and an inclined portion on the inner surface.

Another embodiment of the invention provides a connector. The connector has a contact holder assembly and a housing that receives the contact holder assembly. The contact holder assembly has a movable body portion, a fixed body portion, and a ring elastically combining the movable body portion and the fixed body portion such that the movable body portion moves away from the fixed body portion as the contact holder assembly receives a contact. The movable body portion includes an inner surface and an inclined portion on the inner surface.

Other objects, advantages and salient features of the invention will become apparent from the following detailed description, which, taken in conjunction with the annexed drawings, discloses a preferred embodiment of the invention.

BRIEF DESCRIPTION OF THE INVENTION

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
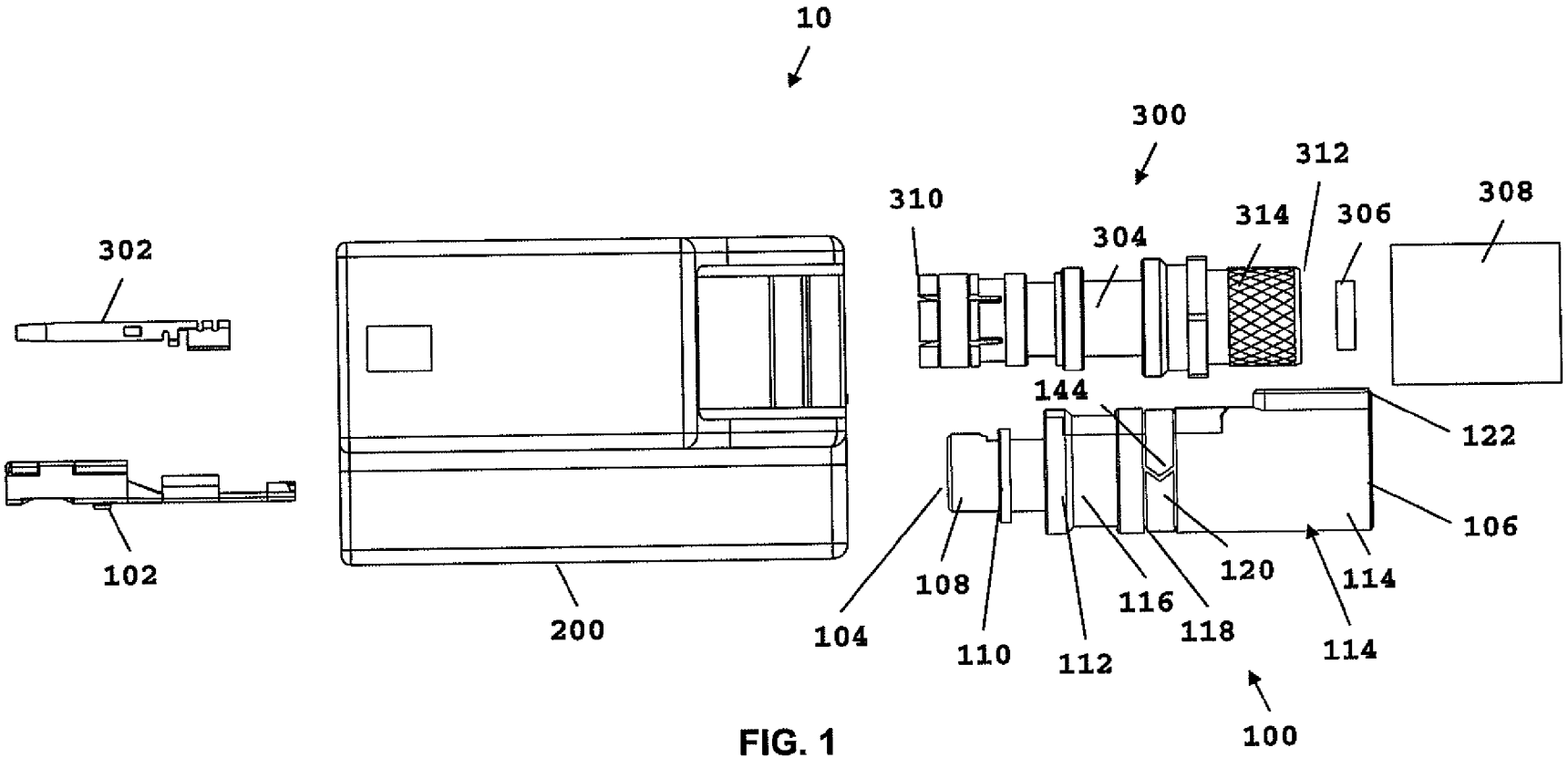
FIG. 1 is an exploded plan view of a connector according to an embodiment of the invention.
Figure 2:
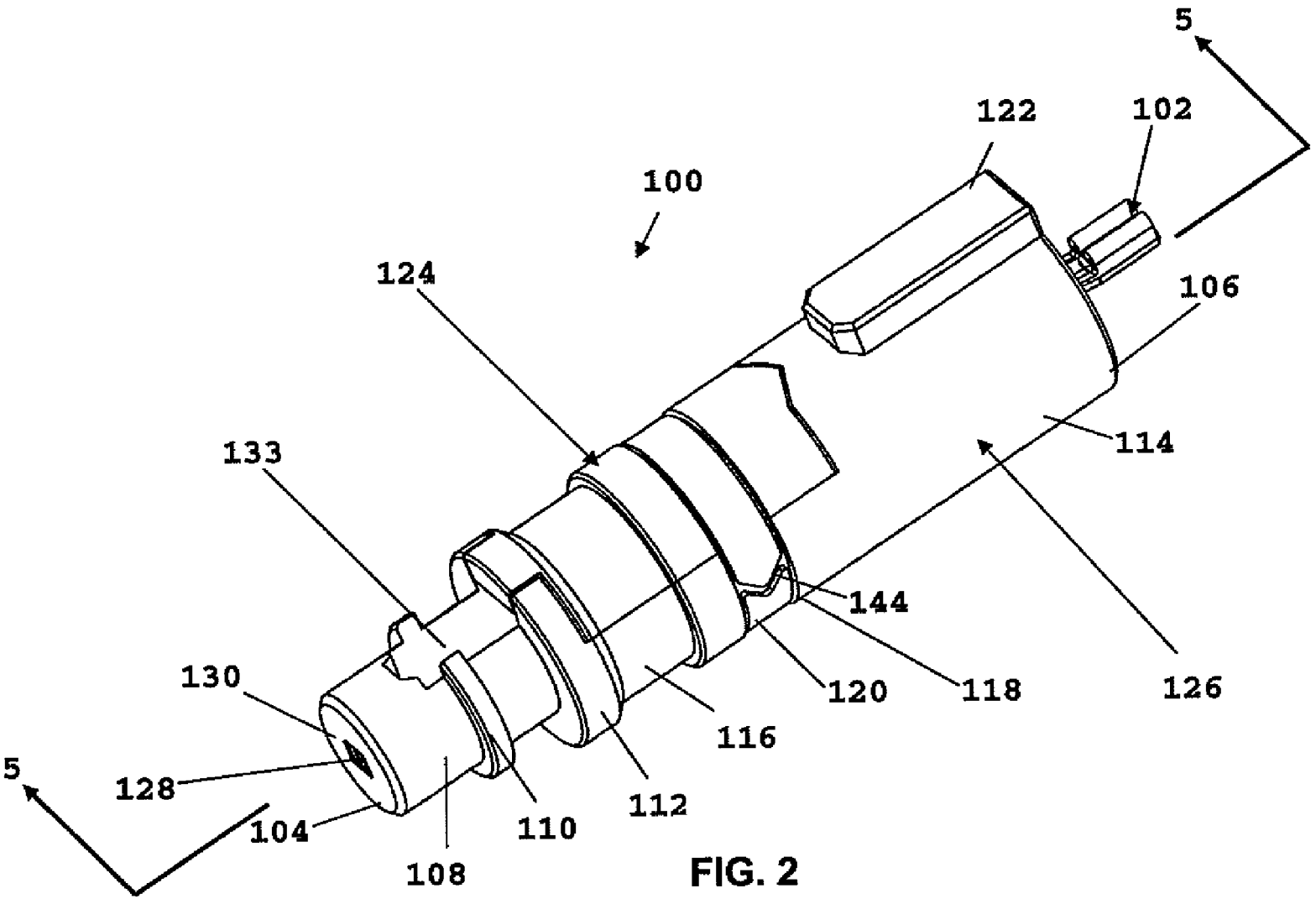
FIG. 2 is a perspective view of a contact holder assembly of the connector illustrated in FIG. 1.

Referring to FIGS. 1-23, an embodiment of the invention provides a contact holder assembly 100 that is received in a housing 200 to form a connector 10. The housing 200 may substantially conform to a FAKRA form factor. Also, the contact holder assembly 100 preferably receives a contact 102. By receiving the contact holder assembly 100, the connector 10 allows the contact 102 to be received in a housing 200 that substantially complies with a FAKRA form factor.

The contact holder assembly 100 can receive different types of contacts 102 and can hold commonly used contacts 102. The contact holder assembly 100 provides a high retention force to the contact 102 while requiring minimal force for combining the contact 102 with the contact holder assembly 100. The contact holder assembly 100 also provides visual, tactile, or audible indications that the contact 102 has been positioned correctly relative to the contact holder assembly 100.

Turning to FIG. 1, the connector 10 is shown in an exploded plan view. The connector 10 includes the housing 200 that receives the contact holder assembly 100 and the contact 102 that is received by the contact holder assembly 100. The connector 10 can include a second contact holder assembly 300 that receives a second contact 302. However, the connector 10 need not have a second contact holder assembly 300. In alternate embodiments, the connector 10 can receive an assembly other than the second contact holder assembly 300, the second contact holder assembly 300 can be the same as the contact holder assembly 100, or the second contact holder assembly 300 can be different than the contact holder assembly 100.

In the embodiment shown, the housing 200 receives the contact holder assembly 100 and the second contact holder assembly 300. By receiving the contact holder assembly 100 and the second contact holder assembly 300, the connector 10 allows at least two contacts 102 and 302 to be received in a housing 200 that substantially complies with a FAKRA form factor. To describe the invention, without intending to limit the invention, the invention is described with reference to the embodiment shown where the contact holder assembly 100 provides a pathway for direct current (DC) power and the contact 102 is a DC contact that is generally used in multi-pin applications. In the embodiment depicted, the contact 102 is a square post contact. The contact holder assembly 100 can also provide a pathway for DC signals, digital signals, low frequency analog signals, or some other signal. In the depicted embodiment, the second contact holder assembly 300 provides a pathway for radiofrequency (RF) signals, and the second contact 302 is a RF contact. Thus, the connector 10 can supply DC power for remote circuitry through the contact holder assembly 100 and a shielded analog signal through the second contact holder assembly 300. Also, the connector 10 allows the use of both coaxial connections and a DC power connection.

The contact holder assembly 100 has a generally elongated form with a first end 104 and a second end 106. The first end 104 is inserted into the housing 200. In the embodiment shown, proceeding from the first end 104 to the second end 106, the contact holder assembly 100 may have a first substantially cylindrical portion 108, a first flange 110 disposed on the first substantially cylindrical portion 108, a second flange 112 disposed adjacent the first substantially cylindrical portion 108, a second substantially cylindrical portion 114 disposed adjacent the second flange 112 opposite the first substantially cylindrical portion 108, a first groove 116 disposed on the second substantially cylindrical portion 114 that accepts a clip 202 (shown in FIGS. 12-19), and a second groove 118 disposed on the second substantially cylindrical portion 114 that accepts a ring 120. The first substantially cylindrical portion 108 has a diameter smaller than the second substantially cylindrical portion 114. The first flange 110 has a diameter larger than the diameter of the first substantially cylindrical portion 108, and the second flange 112 has a diameter larger than the diameter of the second substantially cylindrical portion 114. The first groove 116 and the second groove 118 have diameters smaller than the diameter of the second cylindrical portion 114.

The ring 120 can be a band that wraps substantially around the outermost surface of the contact holder assembly 100. The ring 120 can also have a splitting 144. The ring 120 can be disposed in the second groove 118 so that ring 120 does not move longitudinally with respect to the contact holder assembly 100. The ring 120 is made from plastic, elastomer, metal, or any other material that provides the ring 120 with an elastic characteristic. In the embodiment shown, the ring 120 is a ribbon-like band that is disposed in the second groove 118 and wraps substantially around the second substantially cylindrical portion 114 and has a splitting 144 with a V-like shape.

The second substantially cylindrical portion 114 can have a key 122. The key 122 projects away from the second substantially cylindrical portion 114 to align the contact holder assembly 100 with the housing 200. In the embodiment shown, the key 122 has a substantially box-like structure that mates with a keyway 204 (shown in FIG. 12) in the housing 200.

As shown in FIGS. 2-11, the contact holder assembly 100 is made up of, at least, a movable body portion 124 and a fixed body portion 126. The movable body portion 124 and the fixed body portion 126 combine to form the contact holder assembly 100. The movable body portion 124 and the fixed body portion 126 are mated to each other by the ring 120. In the embodiment shown, when the ring 120 couples the movable body portion 124 and the fixed body portion 126, the movable and fixed body portions 124 and 126 form the second flange 112, the second substantially cylindrical portion 114, the first groove 116, and the second groove 118.

Figure 4:
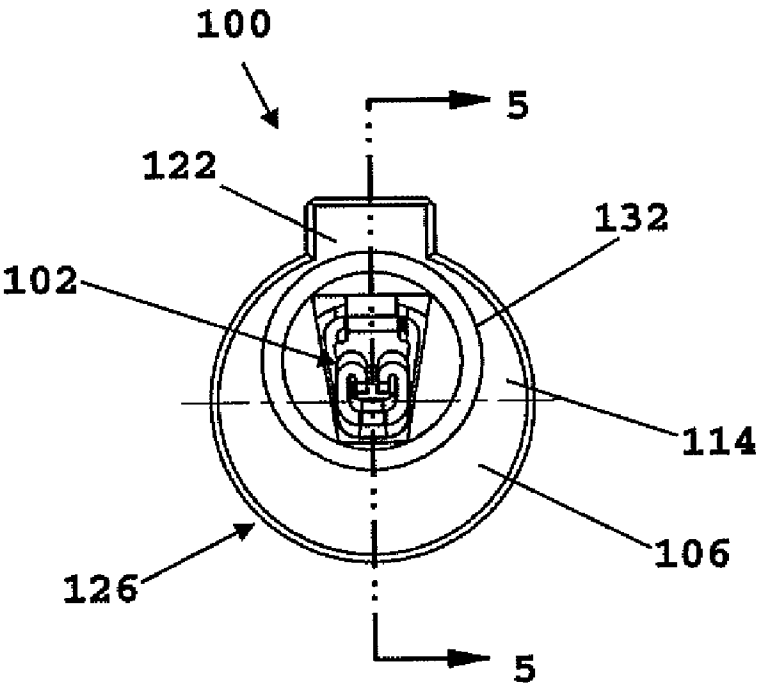
FIG. 4 is a rear elevational view of the contact holder assembly illustrated in FIG. 2.
Figure 3:
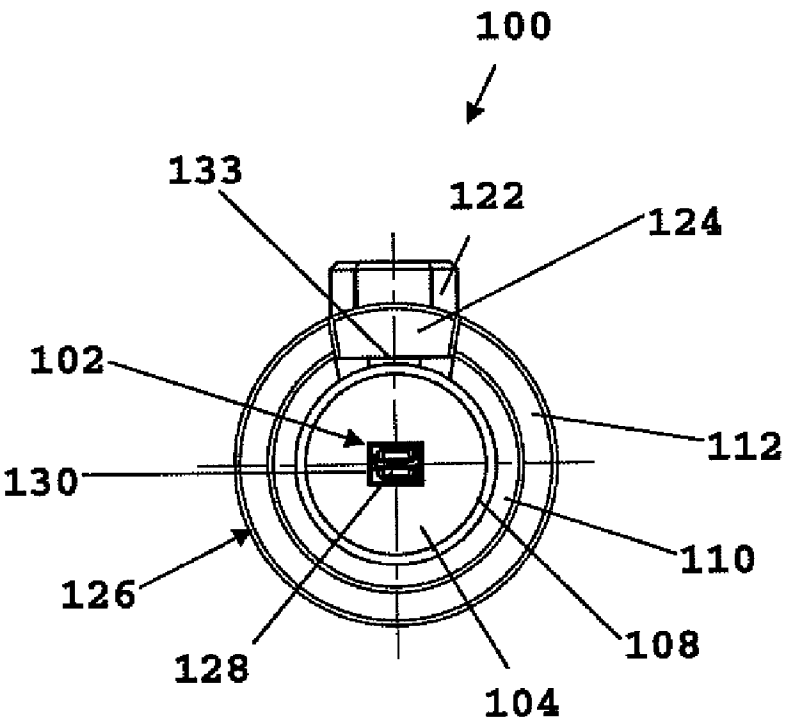
FIG. 3 is a front elevational view of the contact holder assembly illustrated in FIG. 2.

Referring to FIGS. 3-4, a bore 128 extends through the contact holder assembly 100 from the first end 104 to the second end 106. The bore 128 has a first aperture 130 at the first end 104 and a second aperture 132 at the second end 106. The bore 128 can have a cross-sectional shape that varies from the first aperture 130 to the second aperture 132. Thus, the bore 128 can be formed to accept the contact 102 only when the contact 102 is properly oriented with respect to the bore 128. In the embodiment shown, the first aperture 130 can be a substantially rectangular aperture, and the second aperture 132 can be a substantially circular aperture. The shape of the first aperture 130 corresponds to the contact 102. Also, in the embodiment shown, the first aperture 130 is smaller than the second aperture 132 so that the contact 102 can only be received through the second aperture 132. Between the first aperture 130 and the second aperture 132, the bore 128 is shaped to accept the contact 102 when the contact 102 is properly oriented with respect to the contact holder assembly 100. In the embodiment shown, the bore 128 has a generally trapezoidal cross-sectional shape between the first aperture 130 and the second aperture 132. Thus, the bore 128 can only receive the contact 102 in one orientation.

Figure 5:
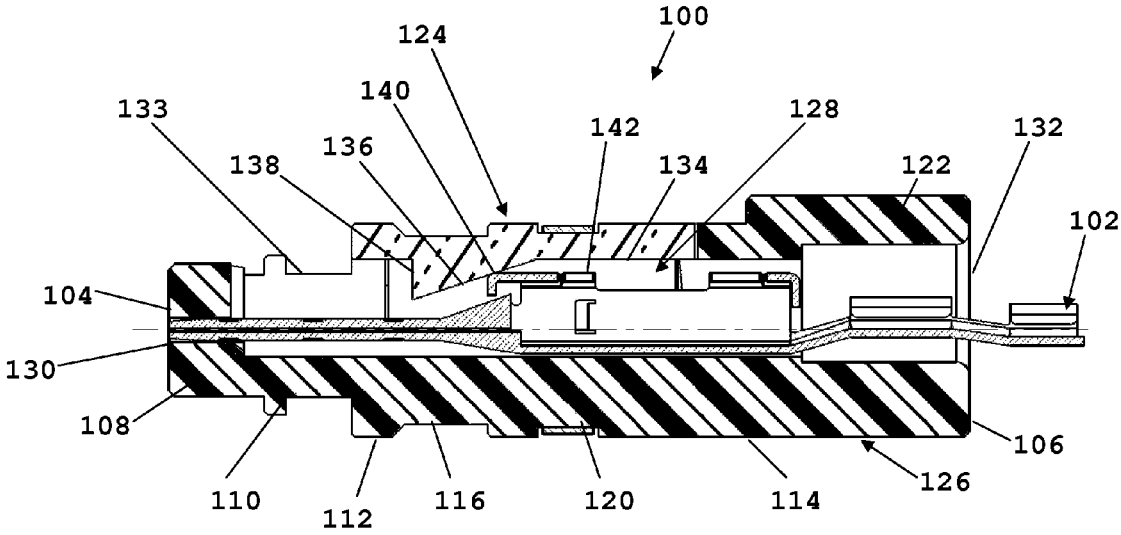
FIG. 5 is a sectional view of the contact holder assembly illustrated in FIG. 2 taken along line 5-5.

Turning to FIG. 5, a window 133 is formed when the movable and fixed body portions 124 and 126 are mated. The window 133 extends from an outermost surface of the contact holder assembly to the bore 128. In the embodiment shown, the window 133 extends from portions of the outermost surfaces of the first substantially cylindrical portion 108 and the first flange 110 to the bore 128.

The contact 102 can be received in the bore 128 through the second aperture 132. The movable body portion 124 has an inner surface 134 facing the bore 128. The inner surface 134 has an inclined portion 136. The inclined portion 136 angles away from the inner surface 134 towards the bore 128 as the inclined portion 136 extends towards the first end 104. Thus, the inclined portion 136 partially narrows the bore 128. The inclined portion 136 can also have a substantially perpendicular portion 138 that is substantially perpendicular to the inner surface 134. The contact 102 has an edge portion 140. As the contact 102 is received in the bore 128, the edge portion 140 travels substantially unobstructed through the bore 128 until the edge portion 140 abuts the inclined portion 136 of the movable body portion 124.

Figure 6:
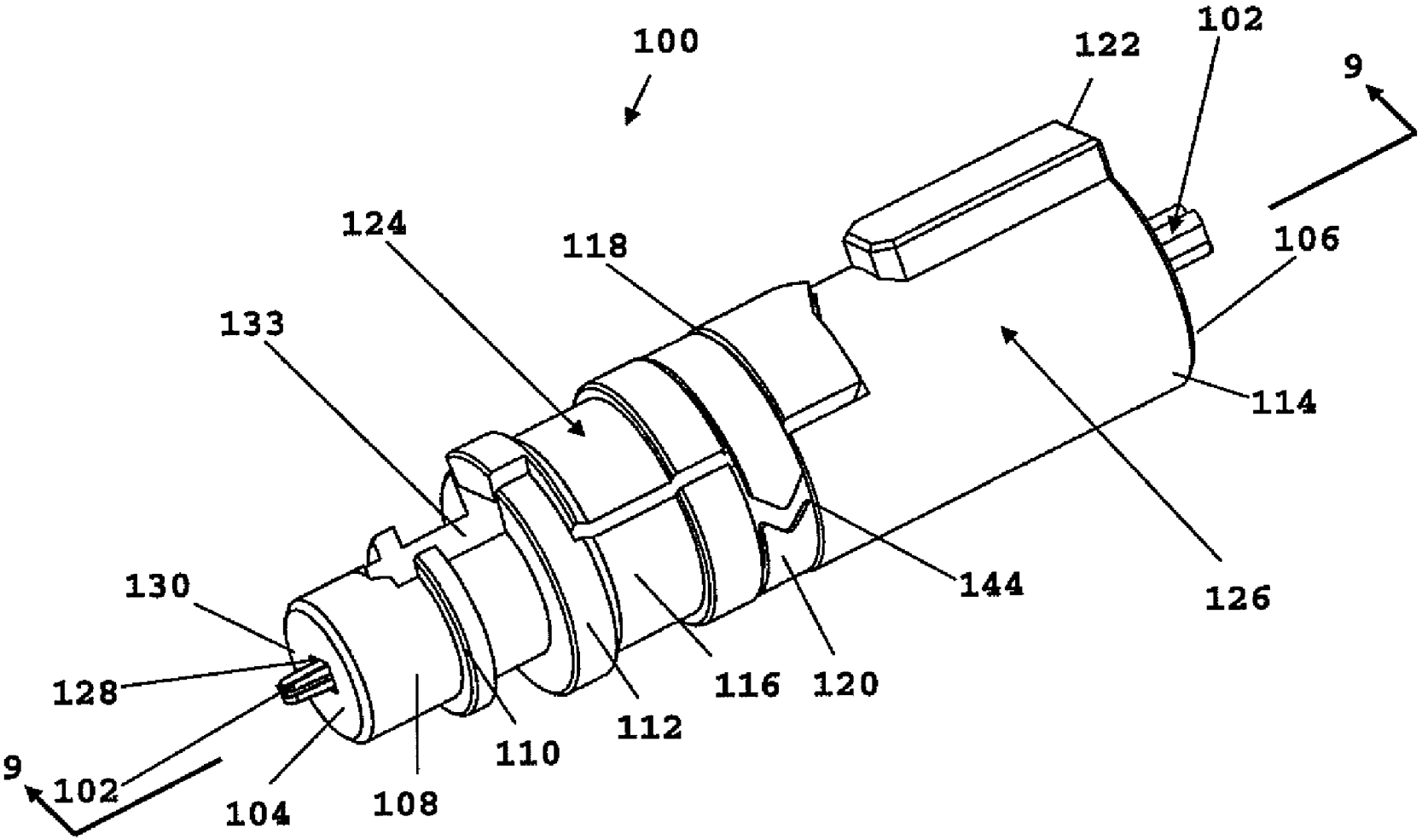
FIG. 6 is a perspective view of a contact holder assembly receiving a contact of the connector illustrated in FIG. 1.
Figure 8:
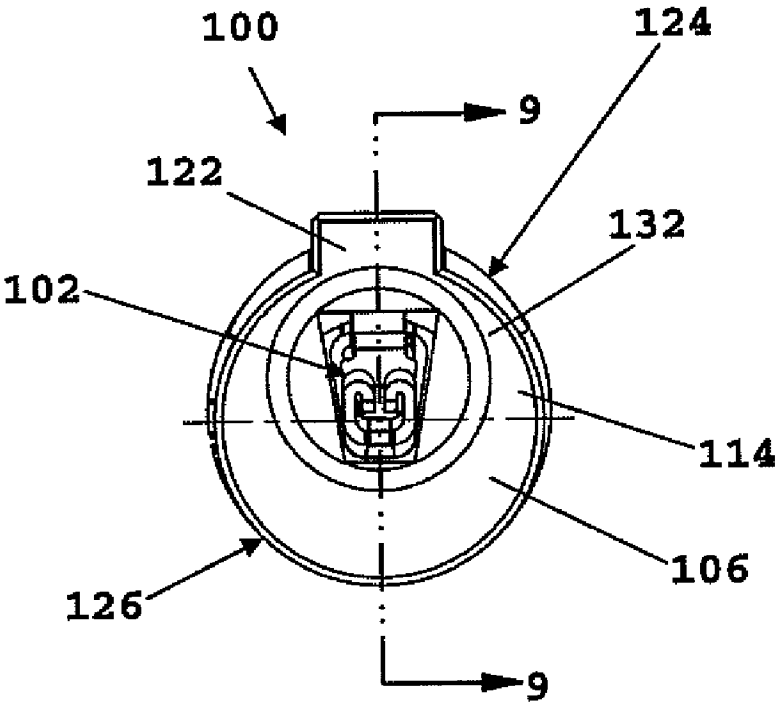
FIG. 8 is a rear elevational view of the contact holder assembly illustrated in FIG. 6.
Figure 7:
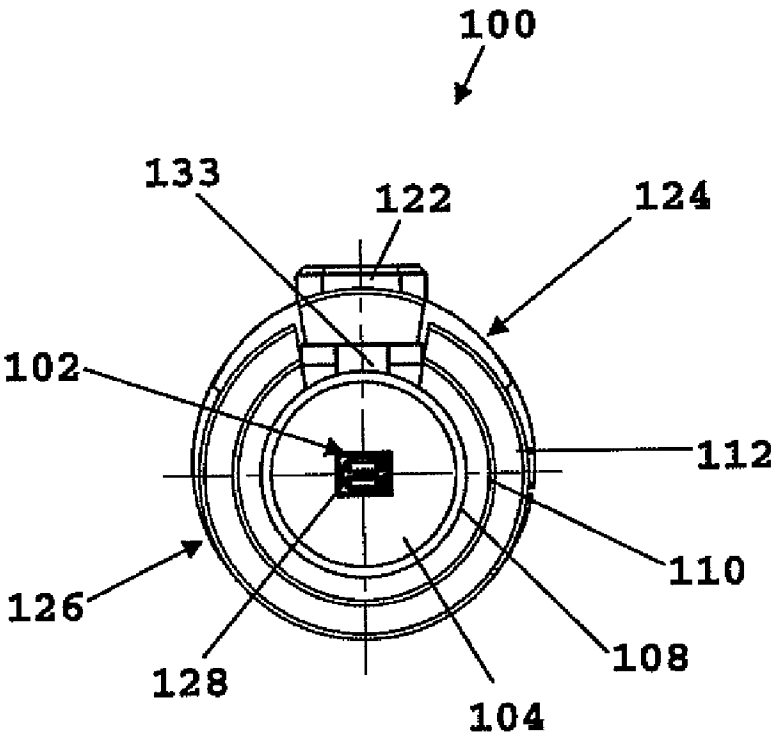
FIG. 7 is a front elevational view of the contact holder assembly illustrated in FIG. 6.
Figure 9:
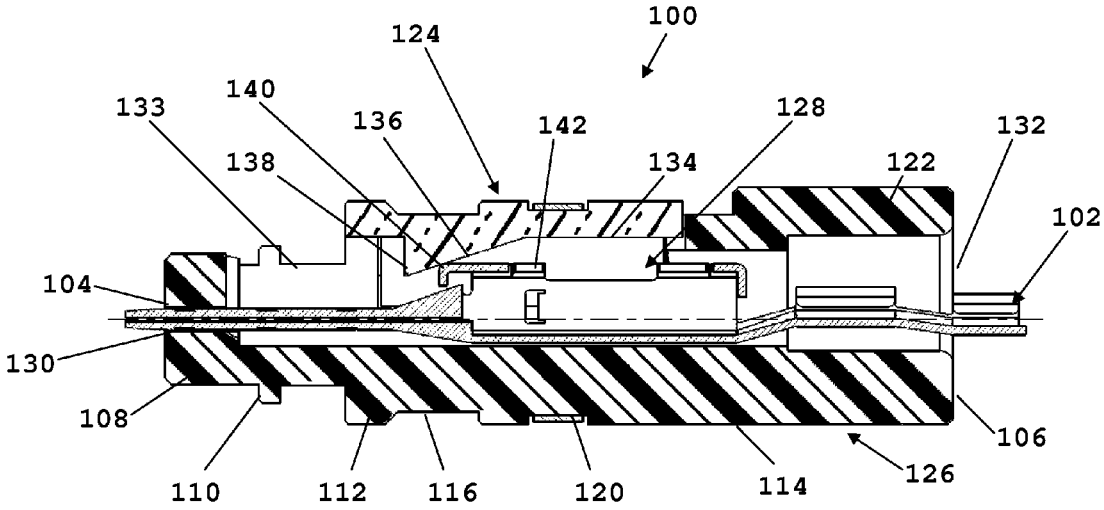
FIG. 9 is a sectional view of the contact holder assembly illustrated in FIG. 6 taken along line 9-9.

Referring to FIGS. 6-9, as the contact 128 continues to travel through the bore 128, the edge portion 140 pushes the inclined portion 136 away from the bore 128 as the edge portion 140 slides past the inclined portion 136. Thus, due to the edge portion 140 engaging the inclined portion 136 of the movable body portion 124, the movable body portion 136 moves away from the fixed body portion 126. As shown in FIG. 6, the ring 120 elastically expands as the movable body portion 124 moves away from the fixed body portion 126. In the embodiment shown, portions of the second flange 112, the second substantially cylindrical portion 114, the first groove 116, and the second groove 118 expand outward with the movable body portion 124. Turning to FIGS. 7 and 8 and comparing those figures to FIGS. 3 and 4, the contact 102 pushes the movable body portion 124 outward as the edge portion 140 of the contact 102 slides past the inclined portion 136. In FIG. 9, the edge portion 140 is shown moving past the inclined portion 136.

Figure 10:
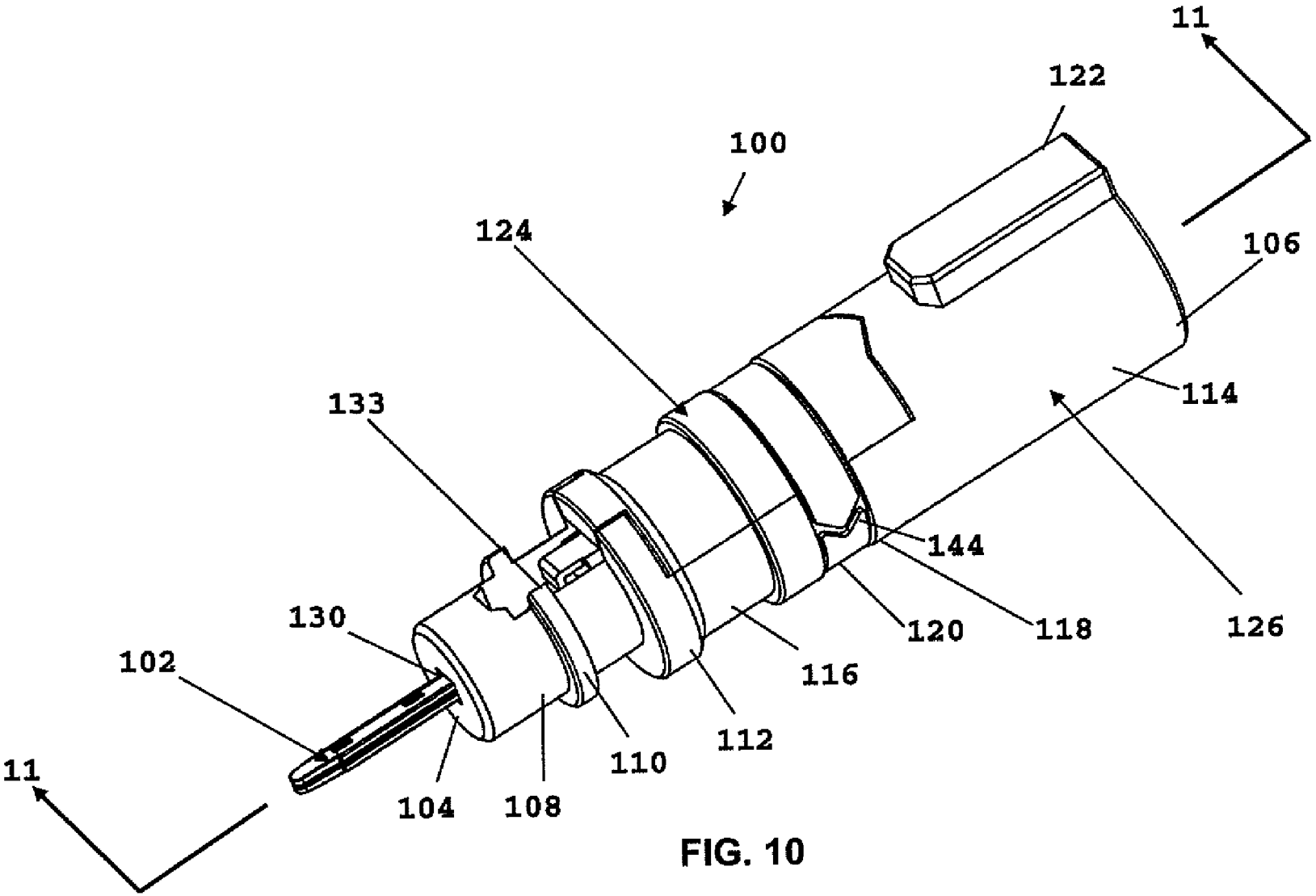
FIG. 10 is a perspective view of a contact holder assembly of the connector illustrated in FIG. 2 mated with the contact.

Referring to FIG. 10, after the edge portion 140 moves past the inclined portion 136, the ring 120 elastically returns the movable body portion 124 to the fixed body portion 126, and the ring 120 returns substantially to its original shape. Thus, the contact holder assembly 100 requires minimal effort to mate the contact 102 with the contact holder assembly 100.

Figure 11:
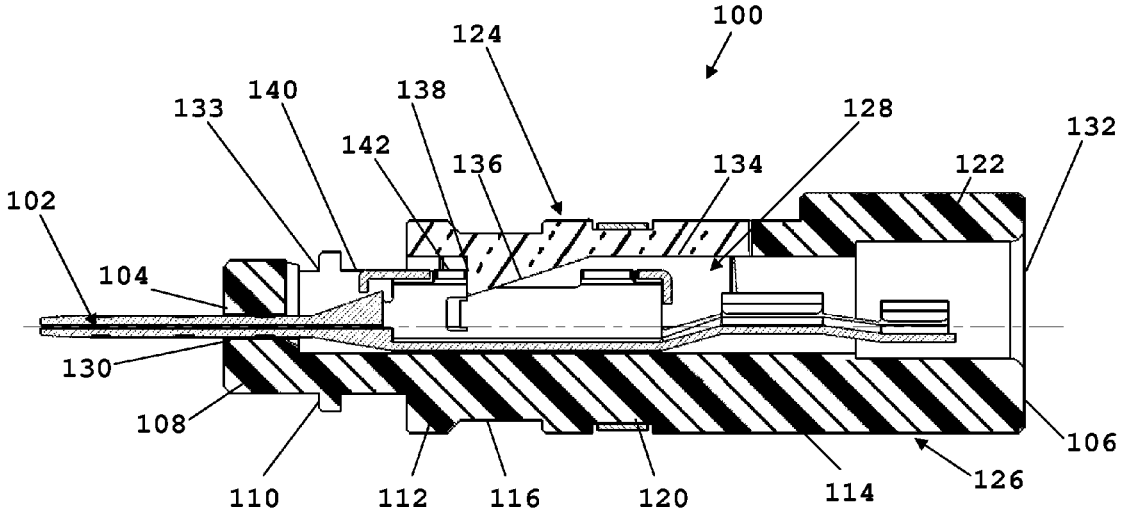
FIG. 11 is a sectional view of the contact holder assembly illustrated in FIG. 10 taken along line 11-11.
Figure 12:
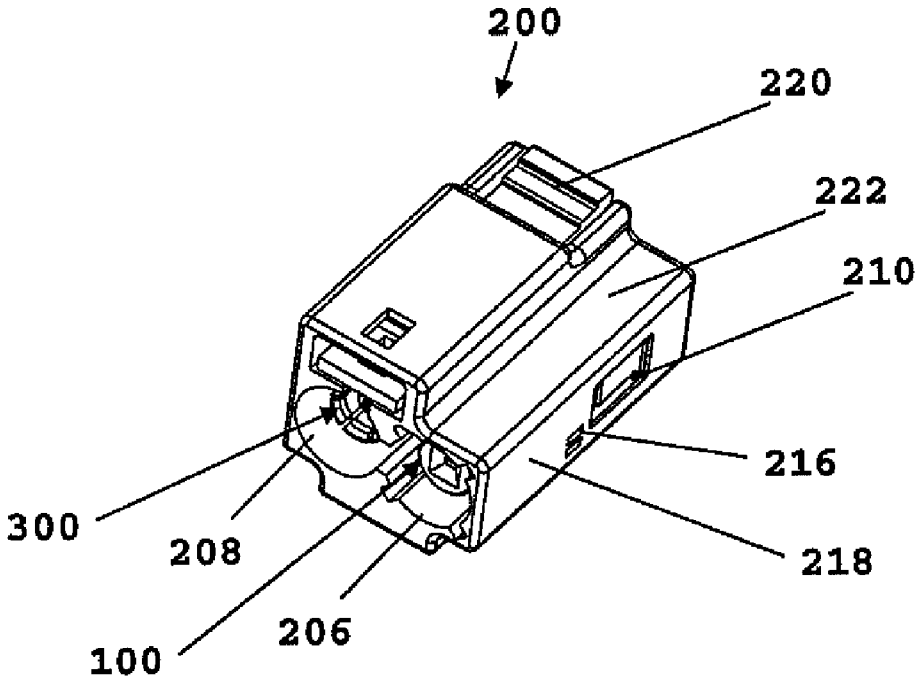
FIG. 12 is a front perspective view of a housing of the connector illustrated in FIG. 1.
Figure 13:
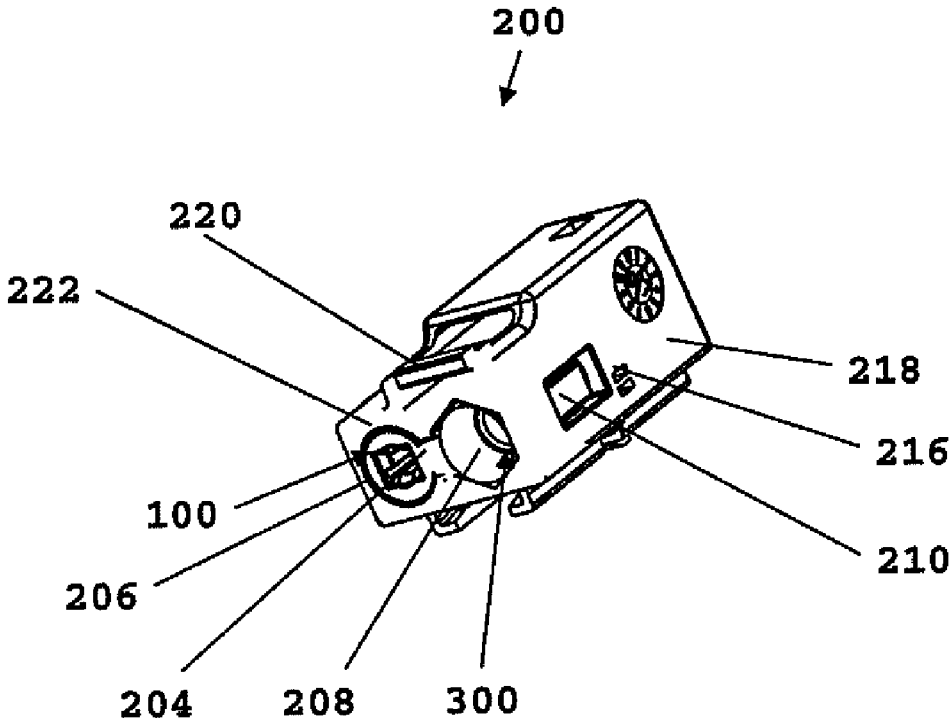
FIG. 13 is a rear perspective view of the housing illustrated in FIG. 12.
Figure 14:
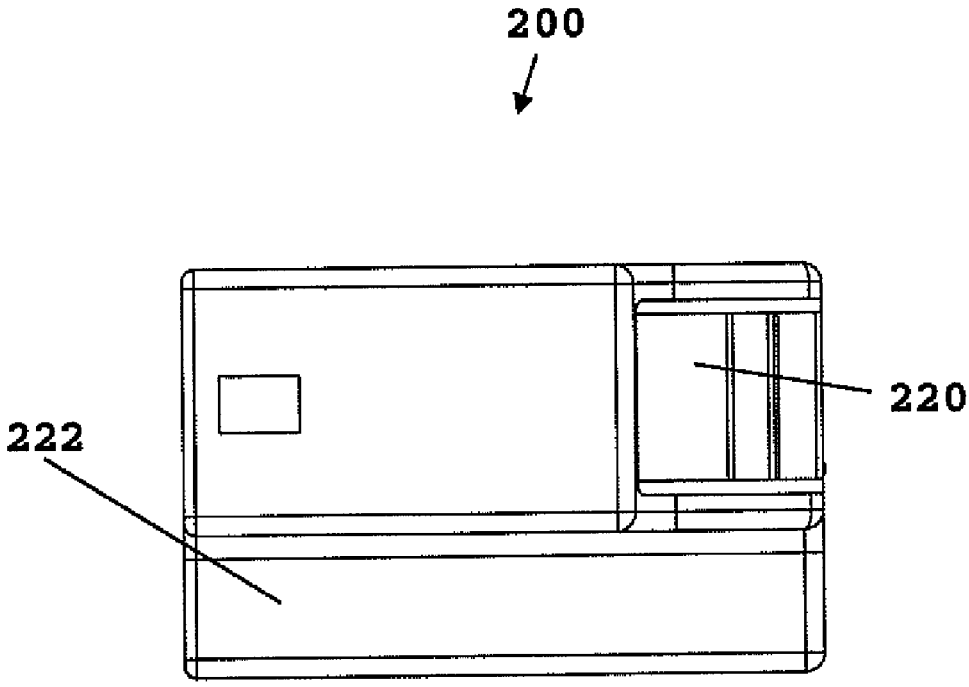
FIG. 14 is a plan view of the housing illustrated in FIG. 12.
Figure 15:
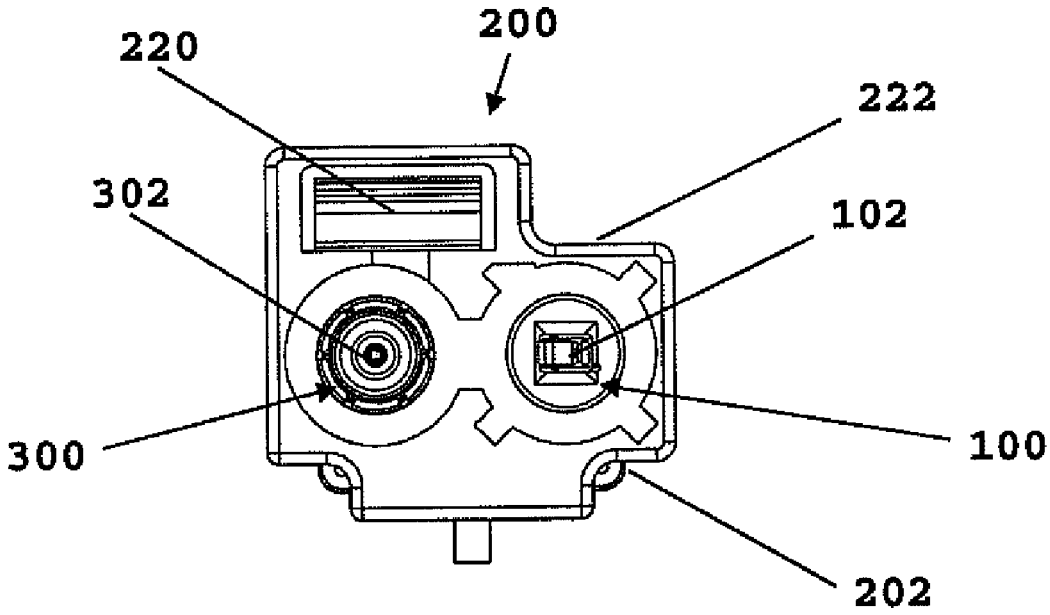
FIG. 15 is a front elevational view of the housing illustrated in FIG. 12.
Figure 16:
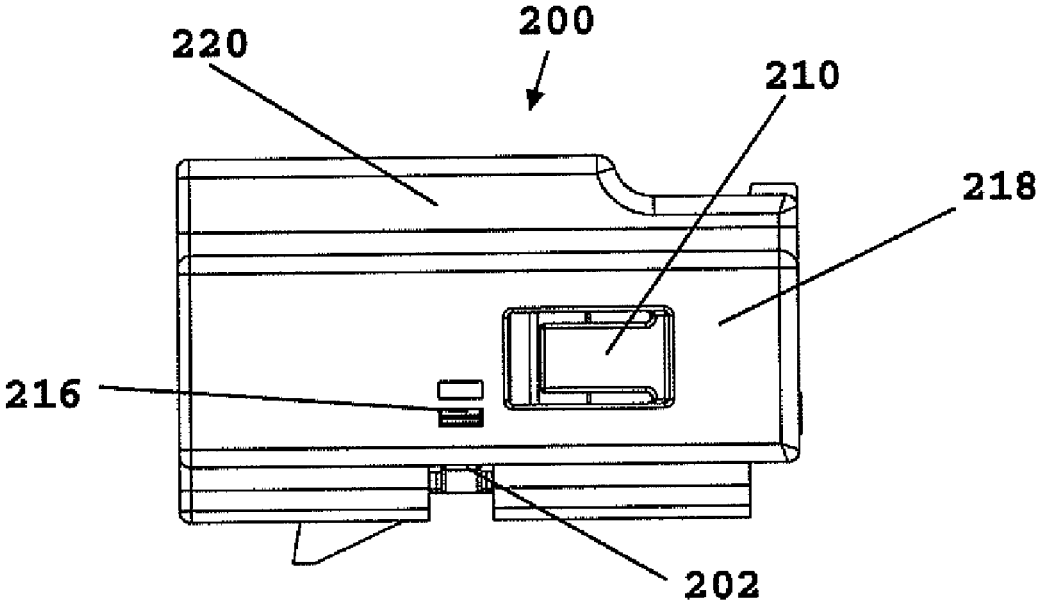
FIG. 16 is a left side elevational view of the housing illustrated in FIG. 12.
Figure 17:
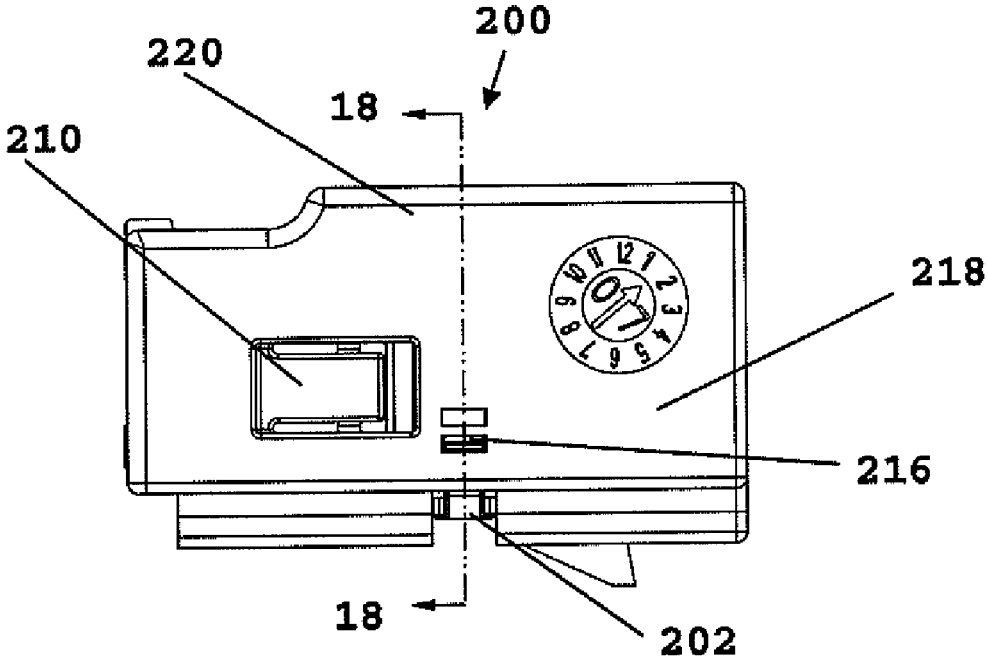
FIG. 17 is a right side elevational view of the housing illustrated in FIG. 12.

Turning to FIG. 11, the substantially perpendicular portion 138 engages a catch 142 on the contact 102. The catch 142 has a surface that mates with the substantially perpendicular portion 138 and prevents the contact 102 from moving back towards the second end 106 of the contact assembly holder 100. Therefore, the contact holder assembly 100 retains the contact 102 longitudinally with respect to the contact holder assembly 100. In the embodiment shown, the catch 142 is an appendage that extends generally transversely to the contact 102 so that the catch 142 can engage with the substantially perpendicular portion 138 of the movable body portion 124.

Also, in the embodiment shown in FIGS. 10 and 11 the edge portion 140 of the contact 102 can be generally seen through the window 133. Thus, the contact holder assembly 100 provides, at least, a visual indication that the contact 102 is substantially positioned correctly relative to the contact holder assembly 100. In other embodiments, the movable body portion 124 or the fixed body portion 126 can be made from a material that allows a portion of visible light to pass through it, such as a translucent or transparent material. In the embodiment shown, the movable and fixed body portions 124 and 126 are made from molded, non-conductive materials, such as polymers, and the movable body portion 124 is translucent or transparent so as to provide another visual indication that the contact 102 is properly positioned in the contact holder assembly 100.

The movement of the movable body portion 124 provides tactile indication that the contact 102 is properly positioned in the contact holder assembly. The user can feel the movable body portion 124 move away from and then return to the fixed body portion 126 as the contact holder assembly 100 accepts and retains the contact 102.

The movable body portion 124 can snap quickly back to the fixed body portion 126 and thus provide an audible indication that the contact 102 is properly positioned with respect to the contact holder assembly 100. In the embodiment shown, after the edge portion 140 slides past the inclined portion 136 and the catch 142 engages the substantially perpendicular portion 138, the ring 120 rapidly returns the movable body portion 124 back to the fixed body portion 126 and creates a snapping sound.

After the contact holder assembly 100 receives the contact 102, the housing 200 receives the contact holder assembly 100. Referring to FIGS. 12-19, the housing 200 is shown. In the embodiment depicted, the housing 200 can receive two contact holder assemblies 100 and 300, as shown in FIG. 1. The housing 200 has a form that preferably substantially complies with a high density (HD) FAKRA form factor, so that the connector 10 with one or more contact assemblies 100 and 300 can be mated with a receptacle (not shown) for FAKRA connectors. The standards for FAKRA connectors are promulgated in DIN 72594-1 or USCAR-18. The embodiment shown is a dual HID-FAKRA jack.

As shown in FIGS. 12-17, the housing 200 may have a block-like form with two longitudinal tunnels 206 and 208 extending the length of the housing 200. The tunnels 206 or 208 can each receive a contact holder assembly 100 or 300. The housing 200 can also have the clip 202 to retain, at least, the contact holder assembly 100 and the keyway 204 that mates with the key 122 to align the contact holder assembly 100 properly with respect to the housing 200. In the embodiment shown, the housing 200 has a latch release 220 on a top surface 222. The latch release 220 disengages the connector 10 from its mating receptacle. The latch release 220 is depressed by a thumb or finger which operates a Class 1 lever (not shown) disposed at the opposite end of the latch release 220.

Figure 18:
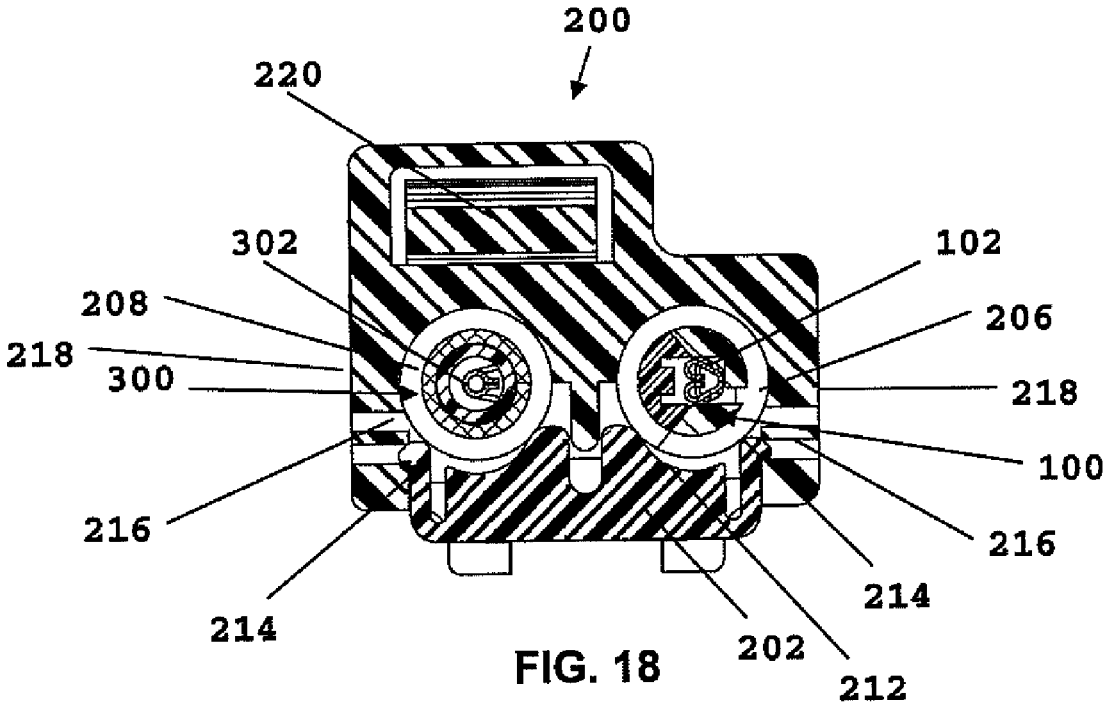
FIG. 18 is a sectional view of the housing illustrated in FIG. 12 taken along line 18-18 with a clip of the housing in a first position.
Figure 19:
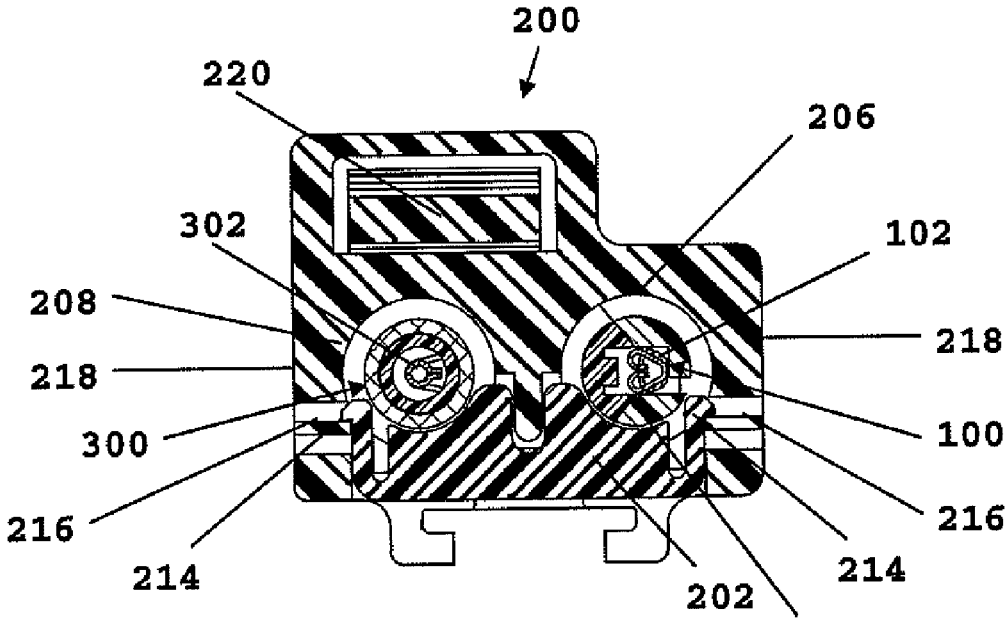
FIG. 19 is a sectional view of the housing illustrated in FIG. 12 taken along line 18-18 with the clip in a second position.
Figure 20:
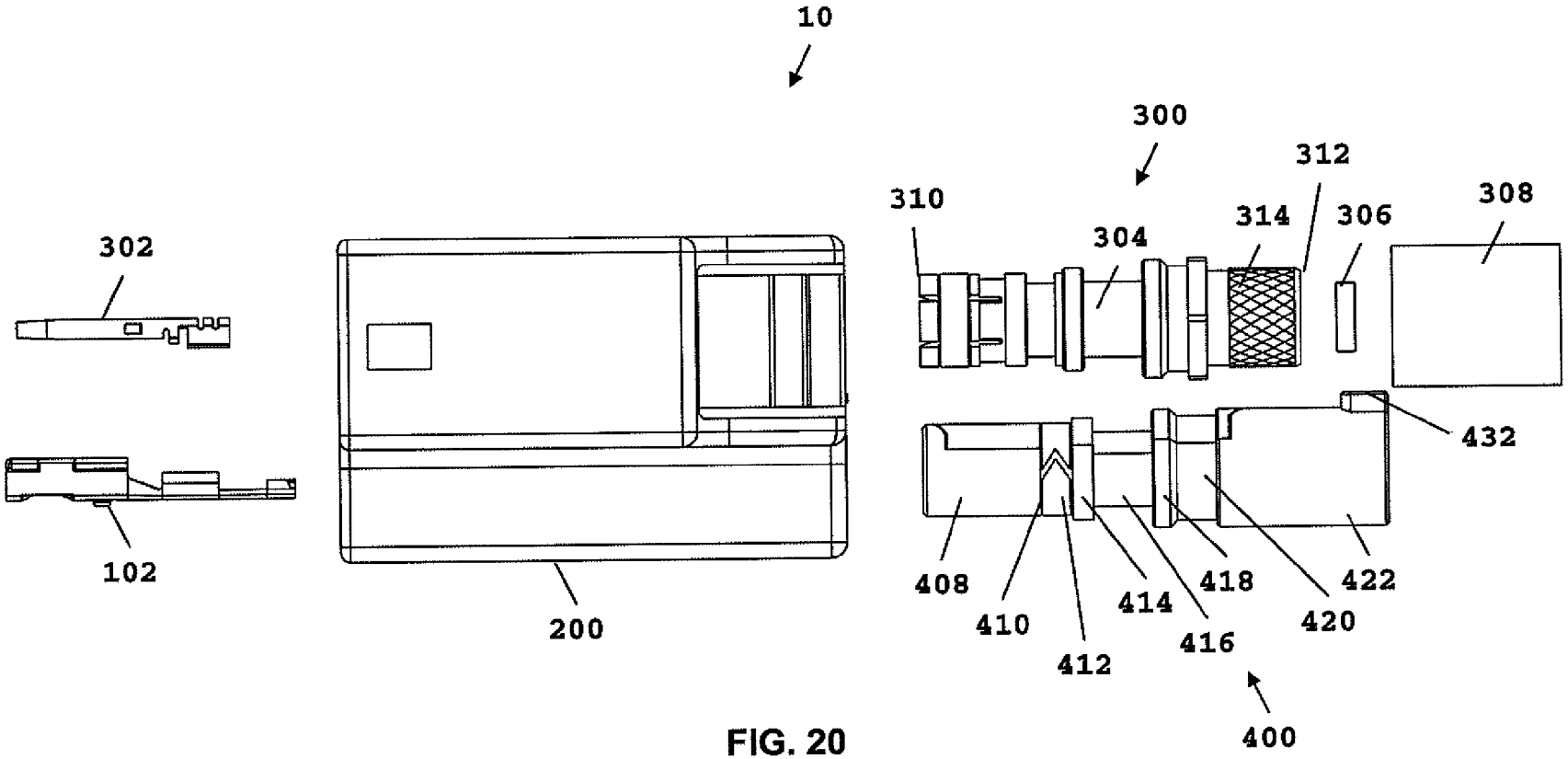
FIG. 20 is an exploded plan view of a connector according to another embodiment of the invention.
Figure 21:
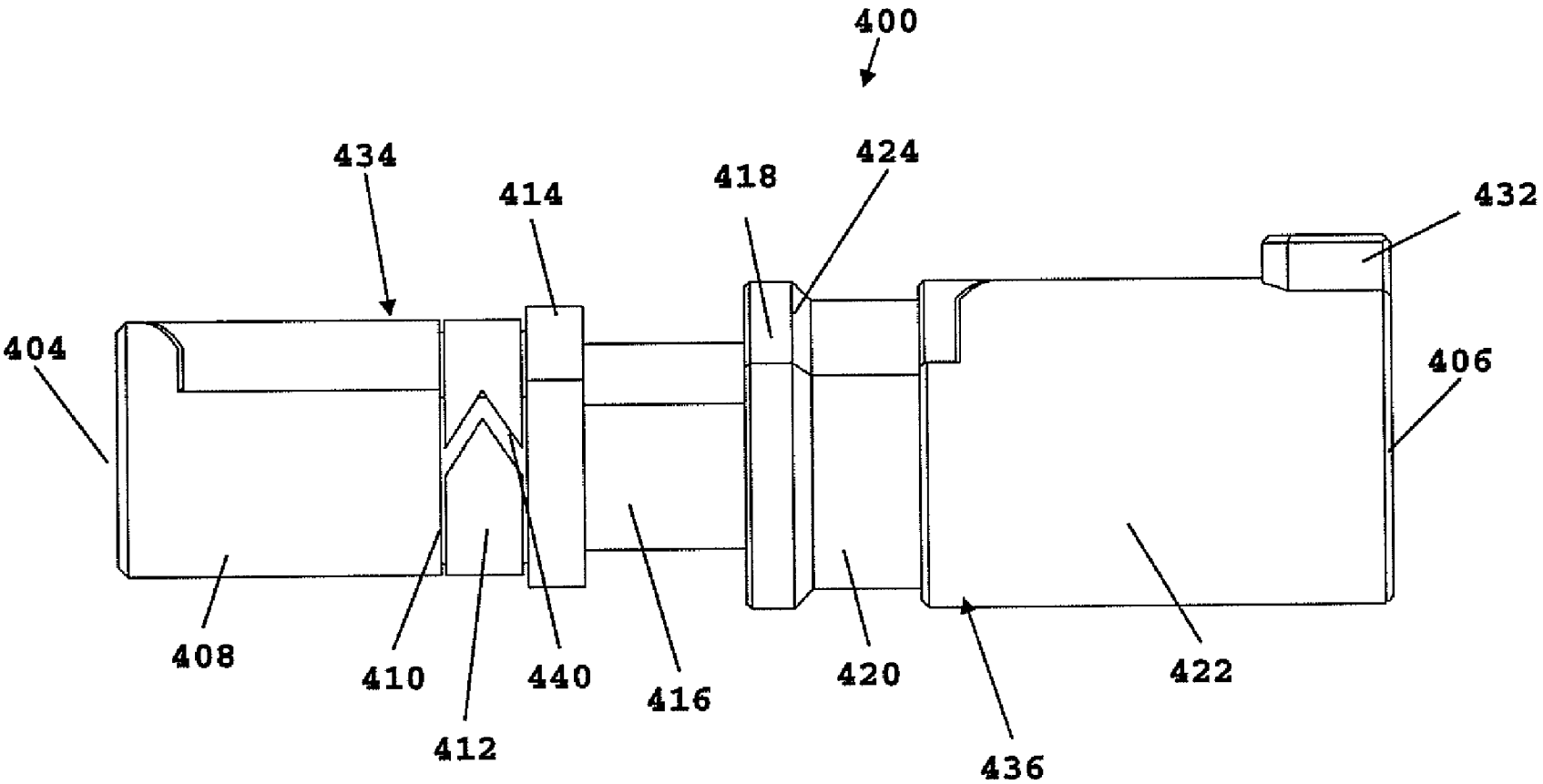
FIG. 21 is a side elevational view of a contact holder assembly of the connector illustrated in FIG. 20.

After the tunnel 206 receives the contact holder assembly 100, the second flange 112 abuts a shoulder (not shown) within the tunnel 206 so that the contact holder assembly 100 cannot be further inserted through the tunnel 206. In the embodiment shown, the contact holder assembly 100 is held by a retainer 210 until the clip 202 can be positioned to couple the contact holder assembly 100 to the housing 200. The retainer 210 is a flexible lever disposed to one side of the tunnel 206, and the retainer 210 frictionally engages the contact holder assembly 100. The clip 202 is disposed in the housing 200 so that the clip 202 is substantially transverse to the tunnel 206. Referring to FIGS. 18-19, the clip 202 can move towards the tunnel 206. After the tunnel 208 receives the contact holder assembly 100, the clip 202 is moved towards the tunnel 208. The clip 202 includes a cutout 212 that engages the first groove 116 of the contact holder assembly 100. The clip 202 can also have at least one clasp 214 that engages a notch 216 in a sidewall 218 of the housing 200. After the clasp 214 engages the notch 216, the clip 202 is coupled to the housing 200, and the clip 202 couples the contact holder assembly 100 to the housing 200.

Returning to FIG. 1, in the depicted embodiment, the second contact holder assembly 300 is for RF signals. The second contact holder assembly 300 can accept a mating coaxial connector (not shown). The second contact holder assembly 300 includes a body sub-assembly 304, an insulator 306, and a ferrule 308. The body sub-assembly 304 has a substantially cylindrical form with a first end 310 and a second end 312. The first end 310 is inserted into the housing 200, and the second contact 302 is received at the first end 310. The second contact 302 is a RF contact. The second end 312 receives the insulator 306 and the ferrule 308. The second end 312 can have a gripping surface 314. The gripping surface 314 can be knurls, grooves, or any other structure that provides for better grasping of the body sub-assembly 304. The insulator 306 is placed around a conductive pin (not shown) at the second end 312, and the ferrule 310 is placed substantially around the second end 312.

In an embodiment made substantially similar to the embodiment shown in FIGS. 1-19 where the fixed body portion 126 is made from nylon 66 with a sulfur yellow color, the movable body portion 124 is made from clear polycarbonate, the ring 120 is made from unplated beryllium copper, the contact 102 is a 0.64 mm square post DC contact made from tin plated phosphor bronze, the contact 302 is a RF contact made from gold plated phosphor bronze, a spacing of approximately 8 mm is provided between the centers of the contacts 102 and 302, the housing 200 is made from polyphenylene ether and polystyrene, the insulator 306 is made from poly(tetrafluoroethylene (PTFE), the ferrule 308 is made from nickel plated soft copper alloy, and the clip 202 is made from polybutylene terephthalate (PBT); the contact holder assembly 300 exhibited the following characteristics: a frequency range extending from approximately DC signals to signals with approximately 200 MHz, a maximum voltage standing wave ratio (VSWR) of about 1.200:1, a minimum dielectric withstanding voltage (DWV) of about 800 VRMS, a minimum durability of approximately 100 cycles, and an operating temperature range between approximately −40° C. to approximately +85° C. The contact holder assembly 300 has an impedance intended for use with a 75 ohm system. Also, the contact holder assembly 300 requires a minimum mechanical pulling force of about 110 N.

Referring to FIGS. 20-23, an alternate embodiment of the contact holder assembly 400 is shown. When compared to the embodiment of FIGS. 1-11, the contact holder assembly 400 has a different shape. The contact holder assembly 400 can receive a contact 102. The contact holder assembly 400 has a generally elongated cylindrical form with a first end 404 and a second end 406. The first end 404 is inserted into the housing 200. In the embodiment shown, proceeding from the first end 404 to the second end 406, the contact holder assembly 400 may have a first substantially cylindrical portion 408, a groove 410 disposed on the first substantially cylindrical portion 408 that accepts a ring 412, a first flange 414 disposed adjacent the first substantially cylindrical portion 408, a sleeve portion 416 disposed adjacent the first flange 414 opposite the first substantially cylindrical portion 408, a second flange 418 disposed adjacent the sleeve portion 416 opposite the first flange 414, a neck portion 420 disposed adjacent the second flange 418 opposite the sleeve portion 416, and a second substantially cylindrical portion 422 disposed adjacent the neck portion 420 opposite the second flange 418. The sleeve portion 416 engages the cutout 212 of the clip 202 so that the contact holder assembly 400 is mated to the housing 200. The first substantially cylindrical portion 408 has a diameter smaller than the second substantially cylindrical portion 422. The first flange 414 has a diameter larger than the first substantially cylindrical portion 408, and the second flange 418 has a diameter larger than the second substantially cylindrical portion 422. The sleeve portion 416 between the first flange 414 and the second flange 418 has a diameter smaller than the first substantially cylindrical portion 408, and the neck portion 420 has a diameter smaller than the second substantially cylindrical portion 422. The second flange 418 can include a bevel 424.

Figure 22:
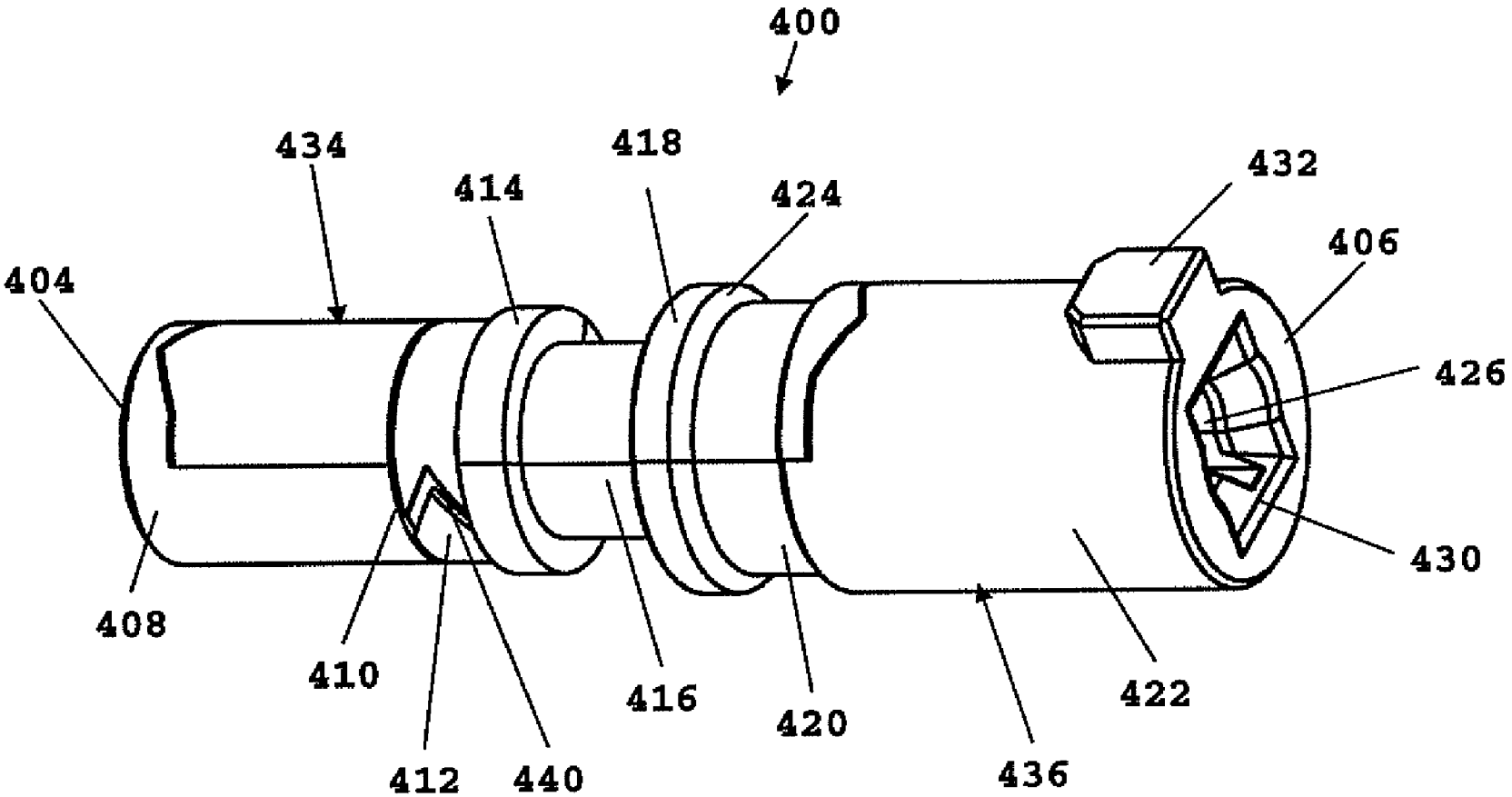
FIG. 22 is a rear perspective view of the contact holder assembly illustrated in FIG. 21.
Figure 23:
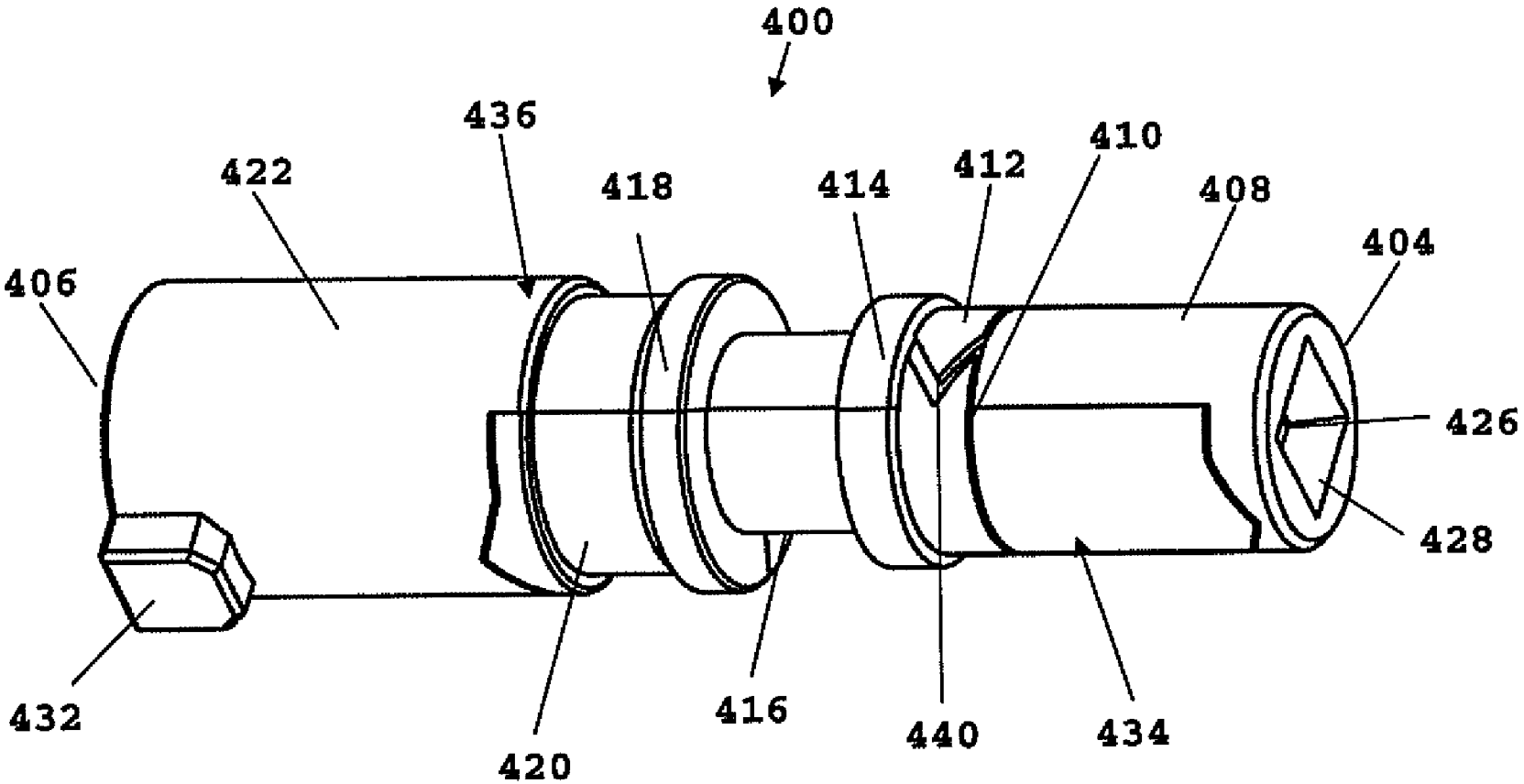
FIG. 23 is a front perspective view of the contact holder assembly illustrated in FIG. 21.

A bore 426 extends through the contact holder assembly 400 from the first end 404 to the second end 406. The bore 426 has a first aperture 428 at the first end 404 and a second aperture 430 at the second end 406. The second aperture 430 receives the first contact 402. In the embodiment shown, the first aperture 428 has a substantially square shape, as shown in FIG. 23, and the second aperture 430 has a substantially rectangular shape with two curved arcs on opposite sides, as shown in FIG. 22.

The second substantially cylindrical portion 422 can have a key 432 that is substantially similar to the key 122 of the contact holder assembly 100. The key 432 projects away from the second substantially cylindrical portion 422 to align the contact holder assembly 400 with the housing 200. In the embodiment shown, the key 432 has a substantially box-like structure that mates with a keyway 204 (shown in FIG. 12) in the housing 200.

Also, the contact holder assembly 400 is made up of a fixed body portion 436 and a movable body portion 434 that are substantially similar to the fixed body portion 126 and the movable body portion 124 of the contact holder assembly 100. The fixed body portion 436 and the movable body portion 434 combine to form the contact holder assembly 400. In the embodiment shown, when the fixed body portion 436 and the movable body portion 434 are coupled, the body portions 434 and 436 form the first substantially cylindrical portion 408, the groove 410, the first flange 414, the sleeve portion 416, the second flange 418, the neck portion 420 and the second substantially cylindrical portion 422. The body portions 434 and 436 are made from molded, non-conductive materials, such as polymers.

The fixed body portion 436 and the movable body portion 434 are mated to each other by the ring 12. The ring 412 is substantially similar to the ring 120 of the contact holder assembly 100, thus a detailed description of the ring 412 is omitted.

The contact holder assembly 400 provides visual, tactile, or audible indication that the contact 102 is properly positioned with respect to the contact holder assembly 400. The indication may be provided either by a window (not shown) in one of the body portions 434 or 436 or by providing a transparent or translucent portion on one of the body portions 434 or 436. The window, transparent portion, or translucent portion provides visual indication that the contact 102 is properly positioned. Also, the mating of the contact 102 with the contact holder assembly 400 provides a tactile and audible indication that the contact 102 is properly positioned when the movable body portion 434 expands outward and returns to the fixed body portion 436. In the embodiment shown, the movable body portion 434 is made entirely clear or translucent.

As apparent from the foregoing description, according to the exemplary embodiment of the invention, the contact holder assembly 100 is configured to mate with different types of contacts 102, retain the contact 102 while requiring minimal effort to mate the contact 102, and provide an indication that the contact 102 is properly positioned with respect to the contact holder assembly 100.

While particular embodiments have been chosen to illustrate the invention, it will be understood by those skilled in the art that various changes and modifications can be made therein without departing from the scope of the invention as defined in the appended claims.

What is claimed is:

1. A contact holder assembly, the contact holder assembly comprising:

a fixed body portion, the fixed body portion having an outer surface with a first groove disposed therein;

a discrete movable body portion mounted in the fixed body portion, the discrete movable body portion having and outer surface with a second groove disposed therein and an inner surface with an inclined portion extending therefrom; and a ring disposed in the first groove and the second groove and elastically coupling the discrete movable body portion to the fixed body portion such that the discrete movable body portion moves away from the fixed body portion as the contact holder assembly receives a contact.

2. A contact holder assembly according to claim 1, wherein the discrete movable body portion and the fixed body portion form a body comprising:

a first substantially cylindrical portion;

a flange at one end of the first substantially cylindrical portion; and a second substantially cylindrical portion adjacent the flange opposite the first substantially cylindrical portion.

3. A contact holder assembly according to claim 2, wherein the body further comprises another flange disposed on the first substantially cylindrical portion.

4. A contact holder assembly according to claim 2, wherein the body further comprises a groove adapted to accept a clip.

5. A contact holder assembly according to claim 2, wherein the body further comprises a key extending from the body.

6. A contact holder assembly according to claim 1, wherein the discrete movable body portion and the fixed body portion form a bore adapted to accept the contact.

7. A contact holder assembly according to claim 6, wherein the body portion further comprises a window that extends to the bore.

8. A contact holder assembly according to claim 1, wherein at least a portion of the discrete movable body portion is made of a material through which a portion of visible light passes.

9. A contact holder assembly according to claim 1, wherein the elastic ring further comprises a splitting.

10. A connector, the connector comprising:

a contact holder assembly having, a fixed body portion, the fixed body portion having an outer surface with a first groove disposed therein, a discrete movable body portion mounted in the fixed body portion, the discrete movable body portion having an outer surface with a second groove disposed therein and an inner surface with an inclined portion extending therefrom, and a ring disposed in the first groove and the second groove and elastically coupling the discrete movable body portion to the fixed body portion such that the discrete movable body portion moves away from the fixed body portion as the contact holder assembly receives a contact; and a housing that receives the contact holder assembly.

11. A connector according to claim 10, wherein the contact is a DC contact.

12. A connector according to claim 10, further comprising a second contact holder assembly.

13. A connector according to claim 12, wherein the second contact holder assembly further comprises a RF contact.

14. A connector according to claim 10, wherein the discrete movable body portion and the fixed body portion form a body comprising:

a first substantially cylindrical portion;

a flange at one end of the first substantially cylindrical portion; and a second substantially cylindrical portion adjacent the flange opposite the first substantially cylindrical portion.

15. A connector according to claim 14, wherein the body further comprises another flange disposed on the first substantially cylindrical portion.

16. A connector according to claim 14, wherein the body further comprises a groove adapted to accept a clip.

17. A connector according to claim 10, wherein the discrete movable body portion and the fixed body portion form a bore adapted to accept the contact.

18. A connector according to claim 17, wherein the body portion further comprises a window that extends to the bore.

19. A connector according to claim 10, wherein at least a portion of the discrete movable body portion is made of a material through which a portion of visible light passes.

* * * * *